US010287848B2

(12) United States Patent
Deng et al.

(10) Patent No.: US 10,287,848 B2
(45) Date of Patent: May 14, 2019

(54) STRUCTURALLY SUPPORTED SEAL ELEMENT ASSEMBLY

(71) Applicant: BAKER HUGHES, A GE COMPANY, LLC, Houston, TX (US)

(72) Inventors: Guijun Deng, The Woodlands, TX (US); Ping Duan, Cypress, TX (US); Yingqing Xu, Tomball, TX (US); Xiao Wang, Chengguan (CN)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 277 days.

(21) Appl. No.: 15/295,118

(22) Filed: Oct. 17, 2016

(65) Prior Publication Data

US 2018/0106125 A1 Apr. 19, 2018

(51) Int. Cl.
*E21B 33/128* (2006.01)
*E21B 33/12* (2006.01)

(52) U.S. Cl.
CPC ..... *E21B 33/128* (2013.01); *E21B 33/1208* (2013.01)

(58) Field of Classification Search
CPC ..... E21B 33/128; E21B 33/1208
See application file for complete search history.

(56) References Cited

U.S. PATENT DOCUMENTS

| | | | | |
|---|---|---|---|---|
| 4,482,170 | A * | 11/1984 | Jacobson | F16L 33/221 285/105 |
| 4,601,194 | A * | 7/1986 | Miller | E21B 47/1015 73/40.7 |
| 6,666,276 | B1 | 12/2003 | Yokley et al. | |
| 7,363,975 | B2 | 4/2008 | Loughlin | |
| 8,490,979 | B2 | 7/2013 | Johnson | |
| 8,905,149 | B2 | 12/2014 | Bailey et al. | |
| 2003/0080515 | A1 | 5/2003 | Milberger et al. | |
| 2005/0230100 | A1 | 10/2005 | Hirth et al. | |
| 2011/0147015 | A1 | 6/2011 | Mickey et al. | |
| 2018/0073323 | A1* | 3/2018 | Merron | E21B 33/128 |

FOREIGN PATENT DOCUMENTS

WO 2010135644 A2 11/2010

* cited by examiner

*Primary Examiner* — Catherine Loikith
(74) *Attorney, Agent, or Firm* — Shawn Hunter

(57) ABSTRACT

A seal assembly features radially stacked sealing elements separated by a ring shaped structural member with the structural member configured to fold on itself as the inner and outer sealing elements are axially compressed during the setting process. The structural member remains embedded in the outer sealing element when the assembly is set. Seal rings flank the inner and outer sealing element and feature an outwardly facing bevel to contact a conforming bevel shape on extrusion ring assemblies. During axial compression the extrusion rings are pushed out with the seal rings and then the inner and outer sealing elements are axially compressed as the structural member's ends come together and its middle folds. The structural member creates gaps to allow fluid to escape during setting.

18 Claims, 3 Drawing Sheets

STRUCTURALLY SUPPORTED SEAL ELEMENT ASSEMBLY

FIELD OF THE INVENTION

The field of the invention is seal assemblies for borehole packers or bridge plugs and more particularly assemblies that use a structural insert separating seal segments that flexes when the packer or bridge plug is set.

BACKGROUND OF THE INVENTION

Conformability, stability and element extrusion are main factors that affect packer sealing performance. Conformability is the ability of the seal to conform to the surface irregularity and imperfection on the casing inside diameter and mandrel outside diameter. Stability is the structural soundness of the seal assembly during set and the pressure above or below thereafter. Any sudden movement of the element during set and after set is considered structural instability, which negatively impacts seal performance. Element extrusion indicates that polymeric sealing material is acting like fluid during set and subsequent pressure above or below, which causes the sealing element to escape any available space or gaps.

Various seal designs are illustrated in U.S. Pat. No. 6,666,276; U.S. Pat. No. 8,490,979; U.S. Pat. No. 7,363,975 US2005/0230100; WO2010135644; US 2003/0080515; US2011/0147015 and U.S. Pat. No. 8,905,149. Lacking in these designs and addressed by the present invention are features such as radially stacked segments separated with a reinforcing member shaped to fold on itself as the seal is axially compressed when set. Seal rings that bookend the sealing element have outwardly facing ramps to guide out anti-extrusion rings with a conforming tapered surface for axial extrusion control. The stacked elements and the reinforcing member that separates them create a gap volume near the mandrel that enables fluid to escape rather than becoming trapped, which could undermine the sealing ability of the sealing assembly. These and other aspects of the present invention will be more readily apparent to those skilled in the art from a review of the description of the preferred embodiment and the associated drawings while appreciating that the full scope of the invention is to be determined from the appended claims.

SUMMARY OF THE INVENTION

A seal assembly features radially stacked sealing elements separated by a ring shaped structural member with the structural member configured to fold on itself as the inner and outer sealing elements are axially compressed during the setting process. The structural member remains embedded in the outer sealing element when the assembly is set. Seal rings flank the inner and outer sealing element and feature an outwardly facing bevel to contact a conforming bevel shape on extrusion ring assemblies. During axial compression the extrusion rings are pushed out with the seal rings and then the inner and outer sealing elements are axially compressed as the structural member's ends come together and its middle folds. The structural member creates gaps to allow fluid to escape during setting.

DETAILED DESCRIPTION OF THE PREFERRED EMBODIMENT

Figure 1:
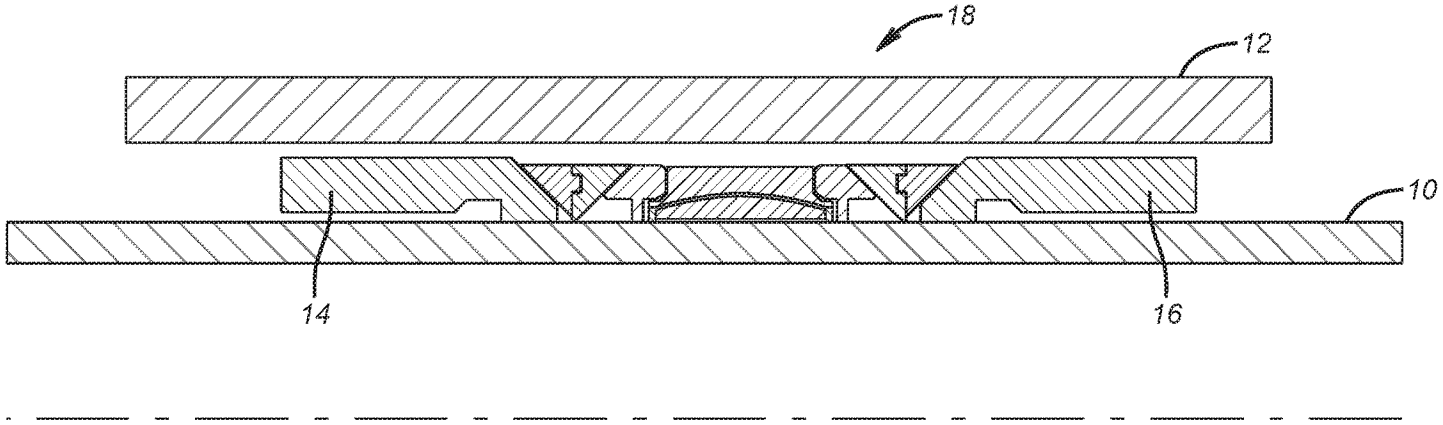
FIG. 1 is a view of the seal assembly in the run in position.
Figure 2:
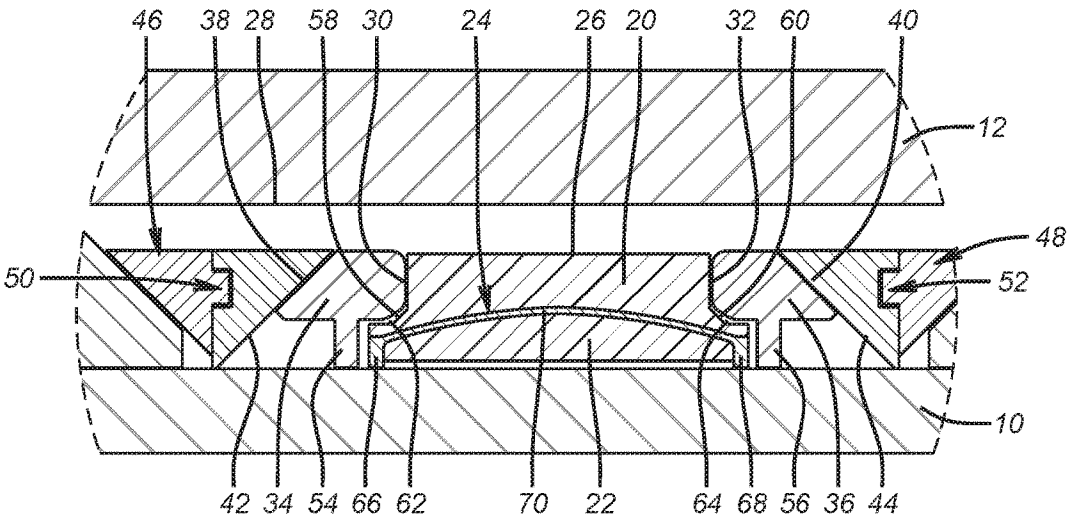
FIG. 2 is an enlarged view of FIG. 1.
Figure 3:
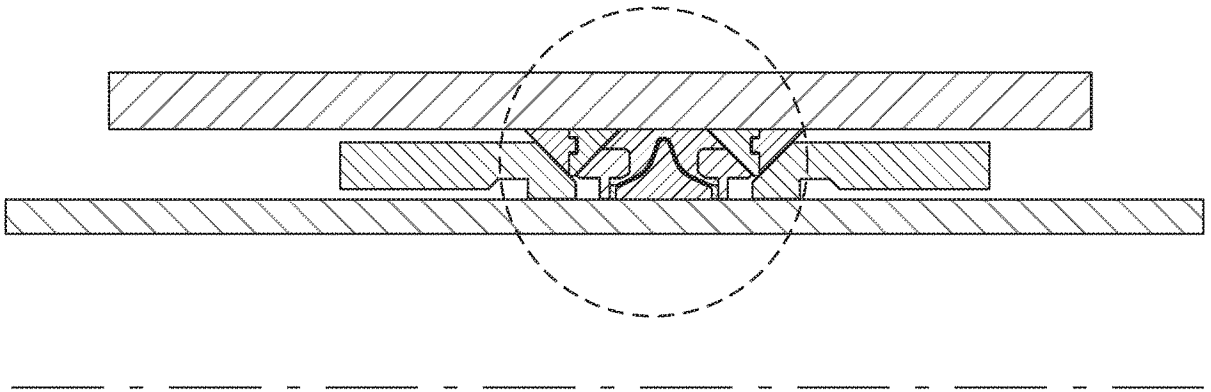
FIG. 3 is the view of FIG. 1 in the set position.
Figure 4:
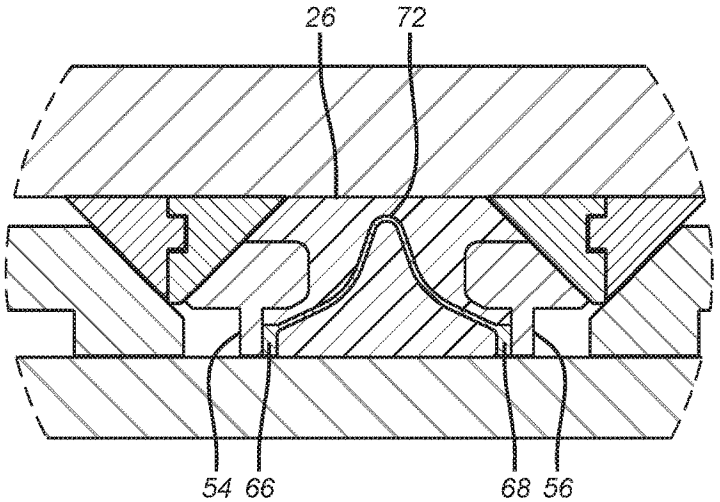
FIG. 4 is an enlarged view of FIG. 3.

Referring to FIG. 1, a mandrel 10 is positioned within a surrounding tubular such as casing 12. Gage rings 14 and 16 are brought together in a known manner to actuate the seal assembly 18 from the run in position of FIG. 1 to the set position of FIG. 3. The component details are best seen in FIG. 2 in enlarged scale. An outer sealing element 20 radially surrounds an inner sealing element 22 and a stiffener assembly 24 separates them. The stiffener assembly is a circular ring structure that can be closed or split or alternatively in segments with circumferential gaps. Stiffener 24 can be adhered to elements 20 or 22 or both or simply abutting them. Outer surface 26 will contact inner wall 28 of the casing 12 when the seal assembly 18 is put into the set position of FIG. 3. Outer sealing element 20 further has side surfaces 30 and 32 against which abut seal rings 34 and 36 respectively. Rings 34 and 36 respectively have tapered surfaces 38 and 40 disposed opposite mating surfaces 42 and 44 of extrusion ring assemblies 46 and 48 respectively. Rings assemblies 46 and 48 are preferably made of two rings locked together with projection/recess combinations 50 and 52. Assemblies 46 and 48 are pushed radially to the borehole wall by rings 34 and 36. Adjacent the bulk of rings 34 and 36 is a radially extending segment 54 and 56 respectively to space the bulk of rings 34 and 36 away from mandrel 10 and to close an extrusion gap along the mandrel. This allows outer sealing element 20 to flare wider under the bulk of rings 34 and 36 as evidenced by transitional surfaces 58 and 60. Note gaps 62 and 64 allow outer and inner sealing components 20 and 22 with the stiffener assembly 24 to align between rings 34 and 36 before setting. The stiffener assembly 24 is preferably metallic although flexible non-metallic materials are also envisioned. Radially oriented end rings 66 and 68 connect to a preferably arced section 70 to complete the stiffener assembly 24. End rings 66 and 68 provide stiffness so that on axial movement of gage rings 14 and 16 relatively toward each other to get the set position of FIG. 3, the arced section 70 preferentially folds along its middle at 72 without coming through exterior surface 26. At the same time the inner sealing element 22 follows the flexing arced section 70 as end rings 66 and 68 get pushed together by radially extending segments 54 and 56.

Figure 5:
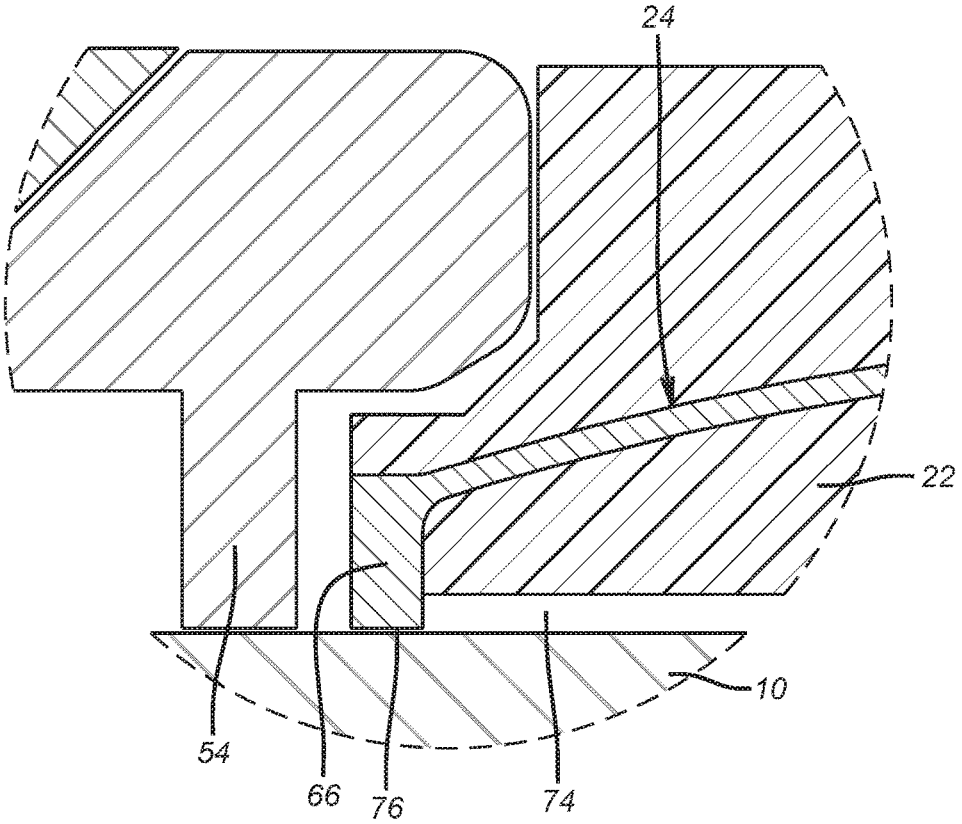
FIG. 5 is a further enlarged view of FIG. 2.

FIG. 5 shows a gap 74 between inner mandrel 10 and inner sealing element 22. There can also be a gap 76 between end rings 66 or/and 68 and mandrel 10 in the run in position. As parts move to the set position any fluids in gap 74 can get past the end rings 66 and/or 68 so that no fluid gets trapped against the mandrel 10 in the set position which could undermine seal effectiveness. Gap 76 can be created with undulations of the bottom surface of rings 66 and 68 or periodic voids that leave gaps for fluid to be displaced during setting.

Those skilled in the art will appreciate that radially stacking an inner and outer sealing element while separating them with a stiffener that folds and stores potential energy allows the assembly in the set position to better resist pressure differentials and to conform to surface irregularities in the surrounding tubular or the mandrel without leaking. The stiffener helps the assembly perform better than a single component sleeve sealing element as the material is also more resistant to axial extrusion. The seal ring design is not only beveled to extend the beveled extrusion barrier but allows the seal rings themselves to act as extrusion barriers. The nesting of the stacked sealing elements with the seal rings and the extending members off the seal rings keep the components in proper alignment as the set position is assumed and maintained. The extending segments being forced against the mandrel in the set position also minimizes any extrusion path along the mandrel. The deliberate gaps present when running in are formulated to allow fluid to escape during the setting to avoid fluid locking which would undermine the sealing capability of the assembly. The stiffener pushes the outer sealing member against the borehole but does not itself contact the borehole. The stiffener bends elastically to store potential energy and provide a continuing sealing force of the seal assembly 18 against the casing 12 or the borehole wall in an open hole. The stiffener preferably does not contact the casing 12 or the borehole wall in an open hole.

The above description is illustrative of the preferred embodiment and many modifications may be made by those skilled in the art without departing from the invention whose scope is to be determined from the literal and equivalent scope of the claims below:

We claim:

1. A seal assembly for a borehole barrier device, comprising:

a mandrel;

an outer sealing member circumferentially overlaying an inner sealing member supported by said mandrel;

a stiffener operably connected to at least one of said inner and outer sealing members; and said outer sealing member is located between spaced seal rings that each further comprise a bevel facing away from said outer sealing member and an extending member toward said mandrel said extending members containing said stiffener in between.

2. The assembly of claim 1, wherein:

said stiffener bends as said sealing members are axially compressed.

3. The assembly of claim 2, wherein:

said stiffener bends adjacent a midpoint thereof.

4. The assembly of claim 1, wherein:

said stiffener is metallic or plastic.

5. The assembly of claim 1, wherein:

said stiffener has opposed end rings to create a gap between themselves and between said inner sealing member and said mandrel, said end rings permitting fluid to pass from said gap as said sealing elements are axially compressed.

6. The assembly of claim 5, wherein:

said end rings are connected by an arced member that separates said inner and outer sealing members.

7. The assembly of claim 6, wherein:

the stiffness of said end rings causes said arced member to bend near a midpoint.

8. The assembly of claim 5, wherein:

said gap closes when said outer sealing member contacts a borehole.

9. The assembly of claim 1, wherein:

said bevels on said seal rings each slidably abut a mating bevel on an anti-extrusion ring assembly such that said seal rings are located axially between said outer sealing member and said anti-extrusion rings.

10. The assembly of claim 1, wherein:

said seal rings overlay said outer sealing member with a radial gap created by said extending members.

11. The assembly of claim 1, wherein:

said extending members close an extrusion gap along said mandrel.

12. The assembly of claim 1, wherein:

said outer sealing member radially overlies said seal ring after axial compression of said outer sealing member.

13. The assembly of claim 12, wherein:

said bevels on said seal rings each slidably abut a mating bevel on anti-extrusion ring assembly such that said seal rings are located axially between said outer sealing member and said anti-extrusion rings;

said seal rings are positioned radially between said mandrel and said outer sealing member when said outer sealing member is against a borehole.

14. The assembly of claim 13, wherein:

said outer sealing member when in contact with the borehole also contacts said extrusion ring assemblies that have been radially extended to the borehole by said seal rings.

15. The assembly of claim 1, wherein:

said stiffener separates said inner and outer sealing members.

16. The assembly of claim 1, wherein:

said stiffener stores potential energy when flexibly bent.

17. The assembly of claim 1, wherein:

said stiffener when bent pushes said outer sealing member against a borehole.

18. The assembly of claim 1, wherein:

said stiffener is adhered to at least one of said inner and outer sealing members.

* * * * *